US012037717B2

(12) United States Patent
Tateyama et al.

(10) Patent No.: US 12,037,717 B2
(45) Date of Patent: Jul. 16, 2024

(54) REINFORCING FIBER BUNDLE

(71) Applicant: Toray Industries, Inc., Tokyo (JP)

(72) Inventors: Masaru Tateyama, Nagoya (JP); Satoshi Seike, Nagoya (JP); Mitsuki Fuse, Nagoya (JP); Hiroshi Hirano, Nagoya (JP); Akihiko Matsui, Nagoya (JP); Kazuma Ura, Nagoya (JP)

(73) Assignee: Toray Industries, Inc., Tokyo (JP)

( * ) Notice: Subject to any disclaimer, the term of this patent is extended or adjusted under 35 U.S.C. 154(b) by 385 days.

(21) Appl. No.: 16/963,089

(22) PCT Filed: Jan. 17, 2019

(86) PCT No.: PCT/JP2019/001218
§ 371 (c)(1),
(2) Date: Jul. 17, 2020

(87) PCT Pub. No.: WO2019/146483
PCT Pub. Date: Aug. 1, 2019

(65) Prior Publication Data

US 2020/0347522 A1 Nov. 5, 2020

(30) Foreign Application Priority Data

Jan. 26, 2018 (JP) ..... 2018-011435
Jan. 26, 2018 (JP) ..... 2018-011436

(51) Int. Cl.
*D06M 15/55* (2006.01)
*D02G 3/24* (2006.01)
*D06M 15/59* (2006.01)

(52) U.S. Cl.
CPC ..... *D02G 3/24* (2013.01); *D06M 15/55* (2013.01); *D06M 15/59* (2013.01)

(58) Field of Classification Search
CPC ..... D04H 1/4242; D06M 2101/12; D06M 2101/40; D06M 2200/40; D03D 15/275;
(Continued)

(56) References Cited

U.S. PATENT DOCUMENTS 5,487,512 A 1/1996 Nojiri et al.
2010/0178495 A1* 7/2010 Taketa ..... B29C 70/305 83/13
(Continued)

FOREIGN PATENT DOCUMENTS

JP 4-24264 A 1/1992
JP 2000-141502 A 5/2000
(Continued)

*Primary Examiner* — Jeremy R Pierce
*Assistant Examiner* — Christine X Nisula
(74) *Attorney, Agent, or Firm* — DLA Piper LLP (US)

(57) ABSTRACT

A reinforcing fiber bundle is a continuous reinforcing fiber bundle having a length of at least 1 m and is characterized by the number of monofilaments per unit width being at most 1,600/mm and the average number of fibers in the bundle being at most 1,000 in a region (I), and the drape level found in a region (II) being 120-240 mm. The continuous reinforcing fiber bundle has a length of at least 1 m and is characterized by the adhesion amount of a sizing agent (I) in the region (I) being 0.5-10% by weight and the drape level found in the region (II) being 120-240 mm. The continuous reinforcing fiber bundle has superior mechanical properties, formability into complex shapes, and continuous producibility.

14 Claims, 3 Drawing Sheets

(58) Field of Classification Search
CPC ..... D01F 9/14; C08J 5/042; C08J 5/06; B29C 70/06; C08K 7/06; B29B 15/12
See application file for complete search history.

(56) References Cited

U.S. PATENT DOCUMENTS

| | | | | |
|---|---|---|---|---|
| 2015/0202807 | A1* | 7/2015 | Sano | B29C 43/20 428/688 |
| 2015/0203642 | A1 | 7/2015 | Sonoda et al. | |
| 2015/0315364 | A1* | 11/2015 | Ohtani | C08J 5/248 524/495 |
| 2017/0008260 | A1 | 1/2017 | Fujii et al. | |
| 2017/0145627 | A1* | 5/2017 | Sakurai | D06M 15/59 |
| 2017/0349720 | A1* | 12/2017 | Hiasa | B05D 3/007 |
| 2017/0355550 | A1 | 12/2017 | Kawahara et al. | |
| 2018/0100043 | A1* | 4/2018 | Takashima | B32B 27/20 |
| 2018/0119317 | A1 | 5/2018 | Ootsubo et al. | |
| 2019/0263625 | A1* | 8/2019 | Motohashi | D04H 1/732 |

FOREIGN PATENT DOCUMENTS

| | | | | |
|---|---|---|---|---|
| JP | 2003-80519 | A | 3/2003 | |
| JP | 2011-241494 | A | 12/2011 | |
| JP | 2013-104156 | A | 5/2013 | |
| JP | 5512908 | B1 | 6/2014 | |
| JP | 5985085 | B2 | 9/2016 | |
| WO | 2016/104154 | A1 | 6/2016 | |
| WO | WO-2016117422 | A1 * | 7/2016 | B05D 3/007 |
| WO | 2016/136812 | A1 | 9/2016 | |
| WO | WO-2017221657 | A1 * | 12/2017 | B29B 15/105 |

* cited by examiner

REINFORCING FIBER BUNDLE

TECHNICAL FIELD

This disclosure relates to a reinforcing fiber bundle suitably used for composite materials.

BACKGROUND

Carbon fiber-reinforced plastics (CFRP), excellent in specific strength and specific rigidity, have actively been developed for automotive materials recently.

Such materials applied to automobiles include a prepreg and a material made of thermosetting resin used for airplanes and sports gear by resin transfer molding (RTM) or filament winding (FW). On the other hand, CFRP made from thermoplastic resin can be formed at high speed molding and excellent recycling efficiency so that they are expected to be a material suitable for mass production. Press forming can form a complicated shape of a large area with resin at a high productivity, and is expected to take the place of metal forming processes.

Press forming is performed mostly with a sheet-shaped material made of discontinuous reinforcing fiber as an intermediate base material. The sheet-shaped materials typically include sheet molding compound (SMC) and glass mat thermoplastic (GMT) as disclosed in JP 2000-141502 A and JP 2003-80519 A. Both of those intermediate base materials, which are used for so-called "Flow Stamping Forming" to charge the die cavity with material flowing inside, comprise relatively long reinforcing fibers dispersed like chopped strand and/or swirl in the thermoplastic resin. Such materials comprising fiber bundles consisting of many single yarns may have poor mechanical properties of shaped product in spite of excellent fluidity during a forming process. From viewpoints of production cost saving and productivity improvement, continuous production of intermediate base materials is required.

JP 5985085 B discloses a forming material having a multi-layer structure consisting of sheets different in fiber length and density parameter capable of achieving both good mechanical property and fluidity. WO 2016/104154 discloses a fiber bundle including separated fiber sections and unseparated fiber sections applicable to a forming material excellent in mechanical properties and fluidity. JP 5512908 B discloses a forming material of which mechanical properties are enhanced by adjusting formation such as thickness and width of fiber bundles. Although the balance between mechanical properties and fluidity has been improved, there is a further demand to improve mechanical properties and fluidity at the time of forming. There is a demand to improve continuous productivity of fiber-reinforced resin forming materials.

Accordingly, it could be helpful to provide a reinforcing fiber bundle capable of continuously producing a fiber-reinforced thermoplastic resin forming material excellent in mechanical properties and fluidity at the time of forming process.

SUMMARY

We Thus Provide:

[1] A continuous reinforcing fiber bundle having a length of 1 m or more, consisting of regions (I) of 150 mm length parts from fiber bundle terminals and region (II) of a part other than the regions (I), the regions (I) having a single yarn number per unit width of 1,600 fibers/mm or less and having an average fiber number in bundle of 1,000 fibers or less, the region (II) having a drape level of 120 mm or more and 240 mm or less.

[2] A continuous reinforcing fiber bundle having a length of 1 m or more, consisting of regions (I) of 150 mm length parts from fiber bundle terminals and region (II) of a part other than the regions (I), the region (I) having a sizing agent adhesion amount of 0.5 wt % or more and 10 wt % or less, the region (II) having a drape level of 120 mm or more and 240 mm or less.

[3] The continuous reinforcing fiber bundle according to [2], wherein a sizing agent made of a water-soluble polyamide is added to the regions (I).

[4] The continuous reinforcing fiber bundle according to any one of [1] to [3], wherein a sizing agent containing an epoxy resin as a main component is added to the region (II).

[5] The continuous reinforcing fiber bundle according to any one of [1] to [4], wherein a sizing agent containing a polyamide resin as a main component is added to the region (II).

[6] The continuous reinforcing fiber bundle according to any one of [1] to [5], wherein the region (II) has an average fiber number in bundle of 50 fibers or more and 4,000 fibers or less.

[7] The continuous reinforcing fiber bundle according to any one of [1] to [6], wherein the region (II) has a bundle hardness of 39 g or more and 200 g or less.

[8] The continuous reinforcing fiber bundle according to any one of [1] to [7], wherein the region (II) has a single yarn number per unit width of 600 fibers/mm or more and 1,600 fibers/mm or less.

[9] The continuous reinforcing fiber bundle according to any one of [1] to [8], wherein the region (II) has an average bundle thickness of 0.01 mm or more and 0.2 mm or less.

[10] The continuous reinforcing fiber bundle according to any one of [1] to [9], wherein the region (II) has an average bundle width of 0.03 mm or more and 3 mm or less.

[11] The continuous reinforcing fiber bundle according to any one of [1] to [10], wherein the region (II) has a sizing agent adhesion amount of 0.1 wt % or more and 5 wt % or less to 100 wt % in total weight of region (II).

We make it possible to provide a reinforcing fiber bundle excellent in formability capable of continuously producing a fiber-reinforced resin forming material having a complicated shape with excellent mechanical properties.

EXPLANATION OF SYMBOLS

Figure 1:
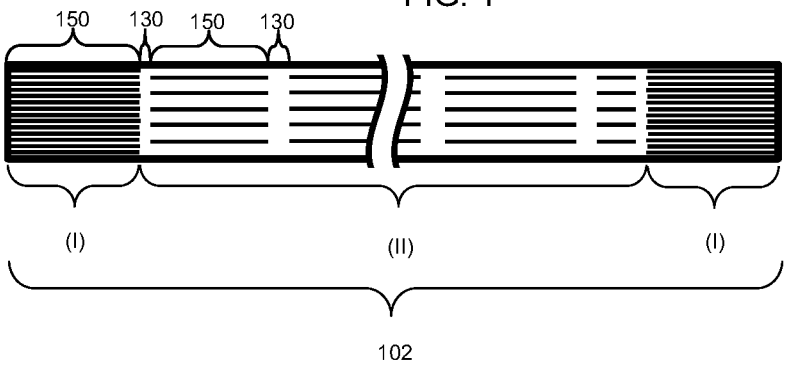
FIG. 1 is a schematic explanation view showing our reinforcing fiber bundle.

100: fiber bundle
102: reinforcing fiber bundle
180: partially-separated fiber bundle
300: partial fiber separation process
301: fiber bundle widening process
400: sizing agent-addition process
401: sizing agent-application process
402: drying process
403: heat treatment process
A-G: pattern
a: fiber bundle running direction

DETAILED DESCRIPTION

Our reinforcing fiber bundle consisting of continuous fiber having a length of 1 m or more has regions (I) of 150 mm length parts from fiber bundle terminals and region (II) of the other part of fiber bundle in FIG. 1. It is preferable that the length of regions (I) is 120 mm or less from the fiber bundle terminals, preferably 80 mm or less. As described later, it is assumed that regions (I) are used for connection of reinforcing fiber bundles and that region (II) is mainly used for reinforcement of fiber-reinforced composite materials. Accordingly, region (I) is preferably shorter to the extent that reinforcing fiber bundles 102 can be connected firmly. The region (I) within the range can connect reinforcing fiber bundles 102 as preventing mechanical properties of fiber-reinforced resin from deteriorating.

It is preferable that the reinforcing fiber is made of fiber selected from a group of carbon fiber, glass fiber, aramid fiber and metal fiber, although it is not limited thereto in particular. Above all, it is preferably made of carbon fiber. From viewpoints of improvement of mechanical properties and lightweight of fiber-reinforced resin, it is preferable that the carbon fiber is based on polyacrylonitrile (PAN), pitch or rayon, although it is not limited in particular. It is possible that one or more kinds of the carbon fiber are used together. Above all, it is preferable to use the PAN-based carbon fiber from a viewpoint of balance between strength and elastic modulus of fiber-reinforced resin obtained.

It is preferable that the reinforcing fibers contained in the reinforcing fiber bundle have a single fiber diameter of 0.5 μm or more. It is more preferably 2 μm or more, preferably 4 μm or more. Further, it is preferable that the reinforcing fibers have a single fiber diameter of 20 μm or less. It is more preferably 15 μm or less, preferably 10 μm or less. It is preferable that the reinforcing fiber bundles have a strand strength of 3.0 GPa or more. It is more preferably 4.0 GPa or more, preferably 4.5 GPa or more. It is preferable that the reinforcing fiber bundles have a strand elastic modulus of 200 GPa or more. It is preferably 220 GPa or more, preferably 240 GPa or more. The strand strength and elastic modulus of reinforcing fiber bundle within the range can enhance the mechanical properties of fiber-reinforced resin forming material.

An example of our reinforcing fiber bundle will be explained specifically with reference to FIG. 1. In FIG. 1, reinforcing fiber bundle 102 is segmentalized and separated longitudinally. The condition of fiber separation process may be different between region (I) and region (II). The separated fiber bundle which has been subjected to the fiber separation process may include unseparated fiber section 130. Unseparated fiber section 130 may be continuous or discontinuous in the width direction of the fiber bundle. In the separated fiber bundle, separated fiber sections 150 facing each other across unseparated fiber section 130 may have the same length or different lengths.

The single yarn number per unit width and the average fiber number in bundle should be determined in a separated fiber part when the fiber bundle has been subjected to the fiber separation process. When the filament containing 10,000 fibers in total is separated equally into 50 pieces, the average fiber number in bundle is determined as 200. And when the fiber bundle has width of 0.5 mm in the separated fiber part, the fiber number per unit width is determined as 400 fibers/mm.

It is preferable that sizing agent (I) is adhered by 10 wt % or less to reinforcing fiber bundle region (I) of 100 wt %. It is more preferable that the adhesion amount is 8 wt % or less, preferably 6 wt % or less. The adhesion amount of sizing agent (I) of more than 10 wt % might harden the fiber bundle and fail to pass the cutting process. It is preferable that sizing agent (I) is adhered by 0.5 wt % or more thereto. It is more preferable that the adhesion amount is 0.7 wt % or more, preferably 1 wt % or more. The adhesion amount of sizing agent (I) of less than 0.5 wt % might reduce the bond strength between fiber bundles. As a result, a part connecting fibers might exfoliate at the time of cutting process.

Each reinforcing fiber bundle which has been separated in region (I) contains reinforcing fibers by average fiber number in bundle (n1) of 1,000 or less. It is more preferable that the average fiber number in bundle is 800 or less, preferably 500 or less. The average fiber number in bundle within the range can easily connect reinforcing fiber bundles by stable strength.

In region (I), the reinforcing fiber bundle has a single yarn number per unit width of 1,600 fibers/mm or less. It is more preferably 1,400 fibers/mm or less, and is more preferably less than 1,250/mm. The number of single yarns of more than 1,600 fibers/mm might loosen entanglement between fibers to decrease connection strength. The single yarn number per unit width of reinforcing fiber bundle can be determined by a method to be described later.

It is preferable that the reinforcing fiber bundle is preliminarily bundled. The condition of "preliminarily bundled" may be a condition of fibers bundled by interlacing yarns constituting the fiber bundle, a condition of fibers bundled by adding a sizing agent to the fiber bundle, or a condition of fibers bundled by giving a twist in the fiber bundle production process.

It is preferable that the reinforcing fiber bundle is treated with a sizing agent to secure a good bundling. Although the reinforcing fiber bundle may be twisted to secure the bundling, it is preferable that the sizing agent is added to the reinforcing fiber bundle to achieve excellent mechanical properties of reinforced fiber composite material as well as a good bundling. The sizing agent is suitably used even for improvement of adhesiveness between matrix resin and reinforcing fibers constituting the fiber-reinforced composite material.

It is preferable that sizing agent (I) is adhered by 3 wt % or less to reinforcing fiber bundle region (I) of 100 wt %. It is more preferable that the adhesion amount is 2 wt % or less, preferably 1 wt % or less. The adhesion amount of sizing agent (I) of more than 3 wt % might loosen entanglement between fibers to decrease connection strength.

It is preferable that sizing agent (I) added to the surface of reinforcing fiber has a solute concentration of 0.01 wt % or more. It is more preferably 0.05 wt % or more, preferably 0.1 wt % or more. The solute concentration of less than 0.01 wt % might worsen the bundling of reinforcing fiber bundle because of less amount of sizing agent (I) adhered to each reinforcing fiber constituting the reinforcing fiber bundle. Also, it might be difficult to obtain composite materials having good mechanical properties when the adhesiveness and affinity are not enhanced sufficiently between reinforcing fibers and matrix resin. It is preferable that sizing agent (I) has a solute concentration of 10 wt % or less. It is more preferably 5 wt % or less, preferably 1 wt % or less. The solute concentration of more than 10 wt % might increase the viscosity of sizing agent (I) so high that it is difficult to add the solute equally to each reinforcing fiber constituting the reinforcing fiber bundle. The adhesion amount of sizing agent (I) can be determined by a method to be described later.

Sizing agent (I) can be added by a well-known means such as spray method, the roller dip method and roller transfer method. These methods may be used solely or combined. Above all, it is preferable to employ the roller dip method excellent in productivity and uniformity. The reinforcing fiber bundle may be dipped in a polymer solution with a dip roller provided in the polymer solution bath to repeat opening and squeezing so that the reinforcing fiber bundle is impregnated with the polymer solution. The adhesion amount of sizing agent (I) can be adjusted by adjusting the polymer solution concentration or the operation of squeeze roller.

It is possible to add a sizing agent for purposes such as prevention of reinforcing fibers from fluffing, improvement of reinforcing fiber bundles in bundling and improvement of matrix resin in adhesiveness. Sizing agents (I) include a compound having a functional group such as epoxy group, urethane group, amino group and carboxyl group. One or more kinds of them can be added together. Such a sizing agent may be added in a production process of reinforcing fiber bundle to be described later.

As described above, it is assumed that regions (I) are used for connection of reinforcing fiber bundles. Region (I) can be used to connect reinforcing fiber bundles to improve mechanical properties and processability of fiber-reinforced composite material. The connection can be achieved in various ways such as injecting pressurized fluid toward overlapped regions (I) of reinforcing fiber bundles to be connected lengthwise, the pressurized fluid being injected with an interlacing means having a pair of series of fluid injection holes provided at intervals in parallel rows each perpendicular to the lengthwise direction so that the reinforcing fibers are tangled with each other. The solute component and adhesion amount of sizing agent (I) can be adjusted preferably so that the reinforcing fiber bundles are connected easily and firmly.

Sizing agent (I) is flexibly selected to join the fiber bundles by fusion or denaturation of sizing agent (I). It is possible to use two or more kinds of sizing agents. It is preferable that sizing agent (I) is a water-soluble polyamide. The water-soluble polyamide is soluble in water by 0.01 wt % or more of solute concentration, and may be made by polycondensation between carboxylic acid and diamine of which the main chain has a tertiary amino group and/or oxyethylene group. The diamine may be a monomer having a piperazine ring and of which the main chain has a tertiary amino group such as N,N'-bis(γ-amino propyl) piperazine and N-(β-aminoethyl) piperazine, or may be an alkyl diamine such as oxyethylene alkylamine of which the main chain has an oxyethylene group. The dicarboxylic acid may be adipic acid, sebacic acid or the like. The water-soluble polyamide may be a copolymer. The copolymer contains a component such as α-pyrrolidone, α-piperidone, ε-caprolactam, α-methyl-ε-caprolactam, ε-methyl-ε-caprolactam and ε-laurolactam. The copolymer may be a binary copolymer or a multicomponent copolymer capable of maintaining the physical property of water solubility with respect to copolymerization ratio. It is preferable that the copolymer contains a component having a lactam ring by 30 wt % or less so that the polymer is completely dissolved in water.

Even a less-soluble copolymer having a copolymerization ratio outside the preferable range can become water-soluble by acidizing the solution with an organic or an inorganic acid. The organic acid may be acetic acid, chloroacetic acid, propionic acid, maleic acid, oxalic acid, fluoroacetic acid or the like. The inorganic acid may be a general mineral acid such as hydrochloric acid, sulfuric acid and phosphoric acid.

From a viewpoint of prevention of thermal deterioration, it is preferable that the water-soluble polyamide as a sizing agent solution applied to reinforcing fiber bundle is dried at a temperature from room temperature to 180° C. to remove water and then subjected to heat treatment. It is preferable that the heat treatment temperature is 130° C. or more, preferably 200° C. or more. It is preferable that the heat treatment temperature is 350° C. or less, preferably 280° C. or less. The heat treatment temperature should be a temperature at which the water-soluble polyamide gets self-cross-linking by atmospheric oxygen or loses the water solubility. Because such a treatment makes the water-soluble polymer insoluble and less hydroscopic, the stickiness of strands of bundled filaments is suppressed to improve workability in post processing while the adhesiveness with matrix materials is improved. Thus, easy-handling fiber bundles can be provided. It is also possible that a cross-linking promoter is added to the solvent so that the heat treatment temperature is lowered and the time is shortened. It is also possible that aging process is performed at an atmospheric temperature of 23±5° C. to enhance the hardness of the fiber bundle.

It is also possible that the reinforcing fiber bundles are connected by heating overlapped regions (I) of reinforcing fiber bundles to be connected lengthwise so that resin is fused or denatured.

Next, region (II) will be explained. As described above, it is assumed that region (II) is mainly used for reinforcement of fiber-reinforced composite materials.

It is preferable that each reinforcing fiber bundle which has been separated in region (II) contains reinforcing fibers by average fiber number in bundle (n2) of 4,000 or less. It is more preferable that the average fiber number in bundle is 3,000 or less, preferably 2,000 or less. The average fiber number within the range can enhance mechanical properties of fiber-reinforced thermoplastic resin forming material. It is preferable that average fiber number in bundle (n2) is 50 or more. It is more preferably 100 or more, preferably 200 or more. The average fiber number within the range can enhance fluidity of fiber-reinforced thermoplastic resin forming material. The average fiber number within the range can be determined by a method to be described later.

It is preferable that sizing agent (II) is added to reinforcing fiber bundle region (II). Sizing agent (II) may contain a solute of compound having a functional group such as epoxy group, urethane group, amino group and the carboxyl group. It is preferable that sizing agent contains a main component of epoxy resin or polyamide resin. One or more kinds thereof may be used together. It is also possible that the sizing agent-added reinforcing fiber bundle is further treated with another kind of sizing agent. The "main component" means a component contained by 70 wt % or more among all solute components.

The epoxy resin may be bisphenol type A epoxy resin, bisphenol type F epoxy resin, novolac type epoxy resin, aliphatic type epoxy resin, glycidyl amine type epoxy resin, or combination thereof.

It is preferable that the sizing agent is a water-soluble polyamide. The water-soluble polyamide may be made by polycondensation between carboxylic acid and diamine of which the main chain has a tertiary amino group and/or oxyethylene group. The diamine may be a monomer having a piperazine ring and of which the main chain has a tertiary amino group such as N,N'-bis(γ-amino propyl) piperazine and N-(β-aminoethyl) piperazine, or may be an alkyl diamine such as oxyethylene alkylamine of which the main chain has an oxyethylene group. The dicarboxylic acid may be adipic acid, sebacic acid or the like.

The sizing agent of water-soluble polyamide resin excellent in affinity with matrix materials can improve composite properties remarkably. From a viewpoint of excellent improvement of adhesiveness, it is preferable to employ polyamide-based resin, polyimide-based resin, polyamide-imide-based resin or polyether-amide-imide-based resin.

The water-soluble polyamide may be a copolymer. The copolymer contains a component such as α-pyrrolidone, α-piperidone, ε-caprolactam, α-methyl-ε-caprolactam, ε-methyl-ε-caprolactam and ε-laurolactam. The copolymer may be a binary copolymer or a multicomponent copolymer capable of maintaining the physical property of water solubility with respect to copolymerization ratio. It is preferable that the copolymer contains a component having a lactam ring by 30 wt % or less so that the polymer is completely dissolved in water.

Even a less-soluble copolymer having a copolymerization ratio outside the preferable range can become water-soluble by acidizing the solution with an organic or an inorganic acid. The organic acid may be acetic acid, chloroacetic acid, propionic acid, maleic acid, oxalic acid, fluoroacetic acid or the like. The inorganic acid may be a general mineral acid such as hydrochloric acid, sulfuric acid and phosphoric acid.

It is preferable that sizing agent (II) is adhered by 5 wt % or less to region (II) of 100 wt %. It is more preferably 4 wt % or less, preferably 3 wt % or less. The adhesion amount of sizing agent (II) of more than 5 wt % might decrease the flexibility of fiber bundle so that excessively hardened fiber bundle cannot smoothly be wound in and wound off the bobbin. It might also cause single yarn breakage so that desirable chopped fiber bundle formation cannot be achieved. It is preferable that the adhesion amount of sizing agent (II) is 0.1 wt % or more. It is more preferably 0.3 wt % or more, preferably 0.5 wt % or more. The adhesion amount of sizing agent (II) of less than 0.1 wt % might decrease adhesiveness between matrix and reinforcing fiber to deteriorate mechanical properties of shaped products. It might also make filaments dispersed as generating fluff so that fibers cannot easily be wound off the bobbin and that fibers wind around a nip roller or a cutter blade. The adhesion amount of sizing agent (II) can be determined by a method to be described later.

The adhesion amount of sizing agent (II) within the above-described range can improve the productivity with improved properties such as smooth winding off the bobbin and reduced winding around the nip roller and the cutter blade. It can also suppress the breakage and single yarn dispersion of chopped fiber bundle so that holding ability of predetermined bundle formation is improved. Namely, a uniform and desirable formation of chopped fiber bundle can be achieved by narrowing the distribution of the number of single yarns forming chopped fiber bundle in the chopped fiber bundle aggregate in which chopped fiber bundles are dispersed. Thus, the fiber bundles can be oriented in plane to improve in mechanical properties. Further, variance of mechanical properties of shaped products can be reduced because the bundle aggregate can be reduced in variance of basis weight.

It is preferable that sizing agent (II) is uniformly adhered to the surface of reinforcing fiber. To make the sizing agent uniformly adhered as such, it is possible that fiber bundles are immersed with a roller in a sizing agent treatment liquid of polymer solution made by dissolving sizing agent (II) in water or alcohol and acidic solution of 0.1 wt % or more, preferably 1 to 20 wt %. It is also possible that fiber bundles are contacted with the sizing agent treatment liquid adhered to a roller and that mist of the sizing agent treatment liquid is sprayed onto fiber bundles, although it is not limited thereto in particular. It is preferable to control parameters such as sizing agent treatment liquid concentration, temperature and yarn tension so that active components of the sizing agent are uniformly adhered to fiber bundles by an appropriate range of adhesion. It is more preferable that fiber bundles are vibrated by supersonic at the time of sizing agent (II)-addition process. It is possible to add the sizing agent by the same method as the above-described sizing agent-adhesion process.

To remove solvent such as water and alcohol in sizing agent (II) adhered to reinforcing fibers, it is possible to employ heat treatment, air-drying or centrifugal separation. From a viewpoint of cost, it is preferable to employ the heat treatment. Heating means such as hot wind, hot plate, roller and infrared heater can be used for the heat treatment. The condition of heat treatment is important from viewpoints of handling ability and adhesiveness with matrix materials. Namely, temperature and time of heat treatment after adding sizing agent (II) to fiber bundles should be adjusted according to components and adhesion amount of sizing agent (II). From a viewpoint of prevention of thermal deterioration, water-soluble polyamide as a sizing agent is dried at a temperature from room temperature to 180° C. to remove water and then subjected to heat treatment. It is preferable that the heat treatment temperature is 130° C. or more, preferably 200° C. or more. It is preferable that the heat treatment temperature is 350° C. or less, preferably 280° C. or less. The heat treatment temperature should be a temperature at which the water-soluble polyamide gets self-cross-linking by atmospheric oxygen or loses the water solubility. Because such a treatment makes the water-soluble polymer insoluble and less hydroscopic, the stickiness of strands of bundled filaments is suppressed to improve workability in post processing while the adhesiveness with matrix materials is improved. Thus, easy-handling fiber bundles can be provided. It is also possible that a cross-linking promoter is added to the solvent so that the heat treatment temperature is lowered and the time is shortened. It is also possible that aging process is performed at an atmospheric temperature of 23±5° C. to enhance the hardness of the fiber bundle.

It is preferable that sizing agent (II) starts the heat decomposition at a temperature of 200° C. or more. It is more preferably 250° C. or more, preferably 300° C. or more. The heat decomposition start temperature can be determined by a method to be described later.

The production method of the reinforcing fiber bundle will be explained specifically with reference to examples. This disclosure, however, is not limited in particular to the examples.

First, reinforcing fiber tows wound off an unwinding device are subjected to a width widening process and fiber separation process. The width widening process and fiber separation process can desirably adjust average fiber number in bundle and the single yarn number per unit width. These processes may be performed constantly or alternatively be performed as changing the widened width in a constant period or any point. It is possible that a fiber separation blade is intermittently inserted into a widened fiber bundle to form a partial separated fiber section in the reinforcing fiber bundle.

Figure 2A:
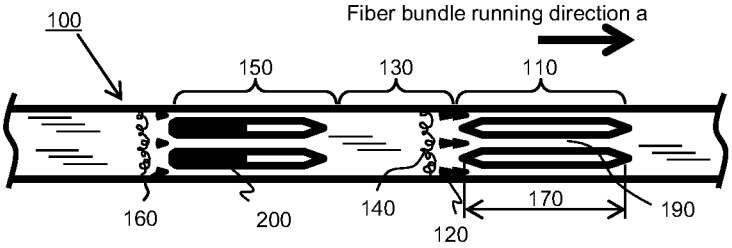
FIGS. 2A and 2B are schematic explanation views showing an example of production method of our reinforcing fiber bundle.
Figure 2B:
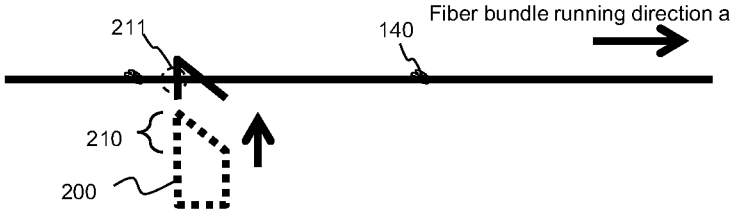

FIGS. 2A and 2B show an example of the fiber separation process. FIG. 2A is a schematic plan view while FIG. 2B is a schematic side view. In FIGS. 2A and 2B, fiber bundle running direction a (arrow) indicates the longitudinal direction of fiber bundle 100 which is continuously fed from a fiber bundle feeding device unshown. Fiber separation means 200 is provided with projection 210 having a projecting shape capable of being stabbed into fiber bundle 100 so that fiber separation part 150 almost parallel to the longitudinal direction of fiber bundle 100 is formed by stabbing fiber separation means 200 into running fiber bundle 100. It is preferable that fiber separation means 200 is stabbed along the side surface of fiber bundle 100. The side face of fiber bundle means a surface (corresponding to side surface of fiber bundle 100 shown in FIGS. 2A and 2B, for example) orthogonal to the end of cross section assuming that the cross section of fiber bundle has a flattened shape such as horizontally long oval and horizontally long rectangle. In addition, projection 210 to possess is good in one in one fiber separation means 200 and may be a plural number again. When one of fiber separation means 200 is provided with a plurality of projections 210, frequency of replacing projections 210 having a reduced abrasion frequency can be reduced. Further, a plurality of fiber separation means 200 can be used simultaneously according to the number of fiber bundles to be separated. Fiber separation means 200 can be provided with arbitrarily disposed projections 210 by a parallel, alternate, shifted layout or the like.

When fiber bundle 100 made from a plurality of single yarns is separated into fiber bundles containing less number of fibers by fiber separation means 200, interlaced section 160 consisting of single yarns interlacing around contact part 211 may be formed during the fiber separation process because single yarns have many interlaced parts which are not oriented substantively in the fiber bundle.

Interlaced section 160 may be formed by shifting interlaced single yarns existing preliminarily in the separated fiber section at contact part 211 by fiber separation means 200. Alternatively, interlaced section 160 may be formed by newly producing aggregates of interlaced single yarns by fiber separation means 200.

Our partially-separated fiber bundles of reinforcing fiber of which surface is coated with application resin are bonded to each other so that single yarns generated by abrasion during the fiber separation process and interlaced section 160 are greatly decreased.

After fiber separation part 150 is generated at any part, fiber separation means 200 is taken off fiber bundle 100. Separated fiber section 110 subjected to the fiber separation process is generated by taking off fiber bundle 100 while interlaced sections 160 generated as described above are accumulated at the end of separated fiber section 110 to generate accumulated interlaced section 120. Fiber bundles drop fluff to generate accumulated fluff 140 around accumulated interlaced section 120 during the fiber separation process.

Then, fiber separation means 200 is stabbed into fiber bundle 100 again to generate unseparated fiber section 130 to form partially-separated fiber bundle 180 consisting of separated fiber section 110 and unseparated fiber section 130 which are disposed alternately along the longitudinal direction of fiber bundle 100. In partially-separated fiber bundle 180, it is preferable that unseparated fiber section 130 is contained by 3 to 50%. The content of unseparated fiber section 130 is defined as a ratio of total length of unseparated fiber section 130 to full length of fiber bundle 100. The content of unseparated fiber section 130 of less than 3% might deteriorate fluidity when partially-separated fiber bundle 180 is cut/dispersed to be used as intermediate base material of discontinuous fiber bundle while the content of 50% or more might deteriorate mechanical properties of shaped product.

As to length of each section, it is preferable that separated fiber section 110 has a length of 300 mm or more and 1,500 mm or less, while unseparated fiber section 130 has a length of 1 mm or more and 150 mm or less.

It is preferable that fiber bundle 100 has a stable running speed which is preferably constant.

It is preferable that fiber separation means 200 has a sharp shape such as metal needle and thin plate, although it is not limited thereto in particular to the extent that the desired effect is achieved. It is preferable that a plurality of fiber separation means are provided in the width direction of fiber bundle 100 subjected to a fiber separation process, in which the number of fiber separation means 200 may be selected according to number F (fibers) of single yarns constituting fiber bundle 100 subjected to the fiber separation process. It is preferable that the number of fiber separation means 200 in the width direction of fiber bundle 100 is (F/10,000-1) or more and less than (F/50-1). When the number is less than (F/10,000-1), mechanical properties of fiber-reinforced composite material produced might not be improved at a later process. When the number is (F/50-1) or more, yarn breakage and fluff might be caused at the fiber separation process.

Figure 3:
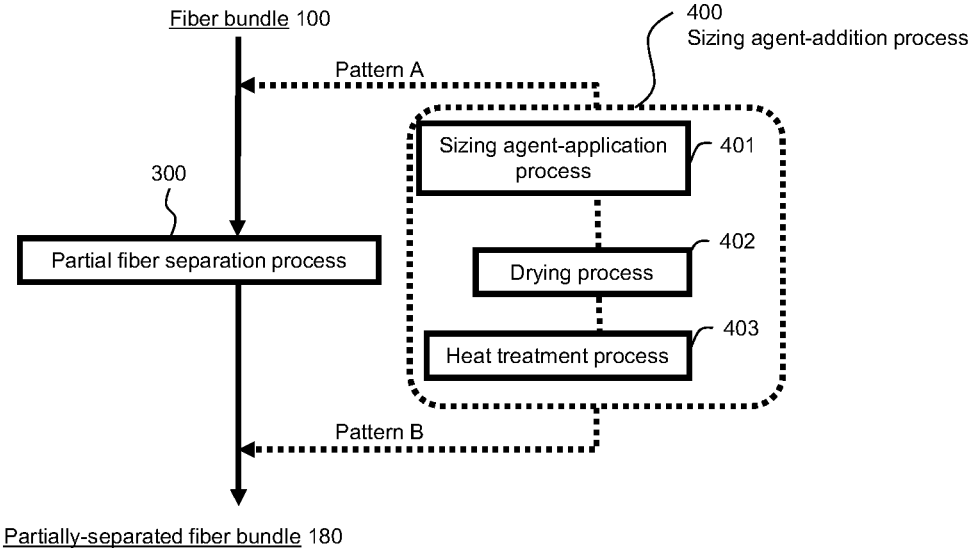
FIG. 3 is an operation flow chart showing timings of partial fiber separation process and sizing agent-addition process.

Next, the timing of adding the sizing agent will be explained. FIG. 3 shows an example of timing of sizing agent-addition process in a production process of reinforcing fiber bundle. In FIG. 3, partially-separated fiber bundle 180 is processed from fiber bundle 100 through partial fiber separation process 300, wherein sizing agent-addition process 400 including sizing agent-application process 401, drying process 402 and heat treatment process 403 is performed before partial fiber separation process 300 in pattern A while sizing agent-addition process 400 is performed after partial fiber separation process 300 in pattern B. It is possible to employ the timing of pattern A or pattern B. Besides, the sizing agent-addition process may not include the drying process and the heat treatment process.

Figure 4:
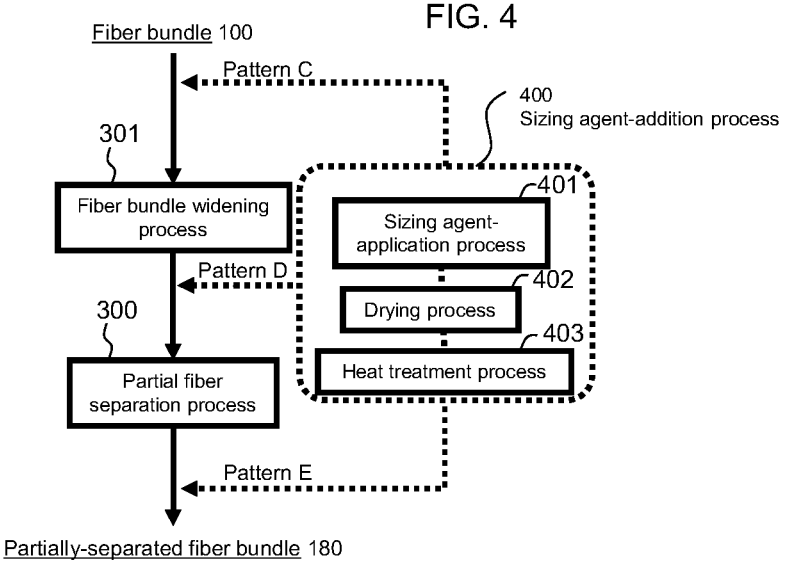
FIG. 4 is an operation flow chart showing timings of fiber bundle widening process, partial fiber separation process and sizing agent-addition process.

FIG. 4 shows an example of timing of sizing agent-addition process 400 in a production process of reinforcing fiber bundle including fiber bundle widening process 301. In FIG. 4, partially-separated fiber bundle 180 is formed from fiber bundle 100 through fiber bundle widening process 301 and partial fiber separation process 300 in this order, wherein sizing agent-addition process 400 is performed before fiber bundle widening process 301 in pattern C, sizing agent-addition process 400 is performed between fiber bundle widening process 301 and partial fiber separation process 300 in pattern D and sizing agent-addition process 400 is performed after partial fiber separation process 300 in pattern E. It is possible to employ the timing of pattern C, pattern D or pattern E. From a viewpoint of desirable partial fiber separation process, it is preferable to employ the timing of pattern D. Besides, the sizing agent-addition process may not include the drying process and the heat treatment process even in the patterns shown in FIG. 4.

Figure 5:
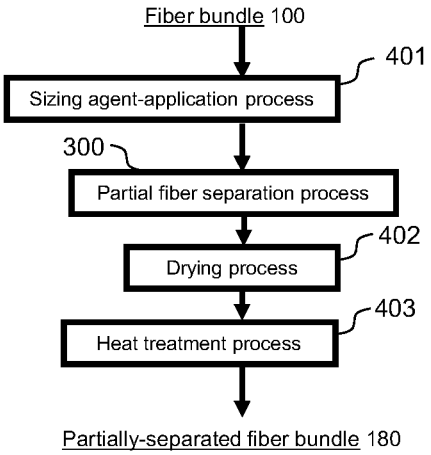
FIG. 5 is an operation flow chart showing an example of sizing agent-addition process, partial fiber separation process, drying process and heat treatment process.

FIG. 5 shows another example of timing of the sizing agent-application process, the drying process and the heat treatment process in a production process of reinforcing fiber bundle. In FIG. 5, sizing agent-application process 401, drying process 402 and heat treatment process 403 are performed at separated timings in sizing agent-addition process 400. Sizing agent-application process 401 is performed before partial fiber separation process 300 while drying process 402 is performed after partial fiber separation process 300.

Figure 6:
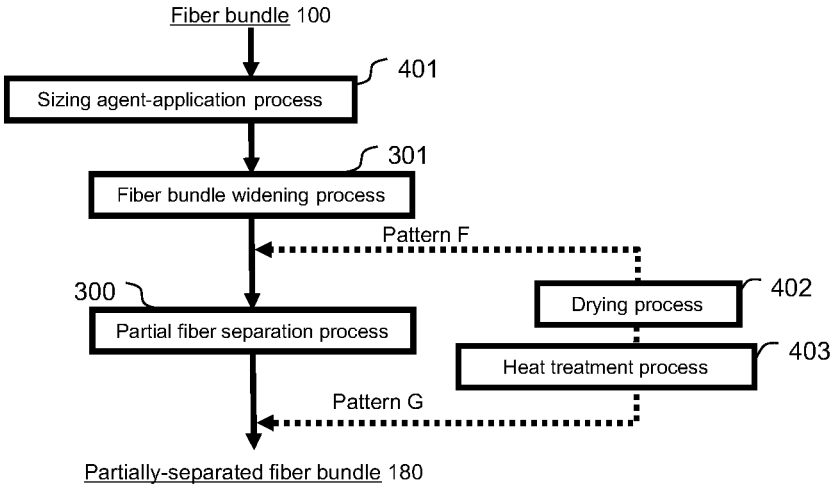
FIG. 6 is an operation flow chart in which sizing agent-application process is performed before fiber bundle widening process.

FIG. 6 shows an example of timing of the sizing agent-addition process including the sizing agent-application process, the drying process and the heat treatment process in a production process of reinforcing fiber bundle including the fiber bundle widening process in which partially-separated fiber bundle 180 is formed from fiber bundle 100 through fiber bundle widening process 301 and partial fiber separation process 300 in this order, wherein sizing agent-application process 401 of sizing agent-addition process is performed before fiber bundle widening process 301 while drying process 402 and heat treatment process 403 are performed between fiber bundle widening process 301 and partial fiber separation process 300 in pattern F and drying process 402 and heat treatment process 403 are performed after partial fiber separation process 300 in pattern G.

Figure 7:
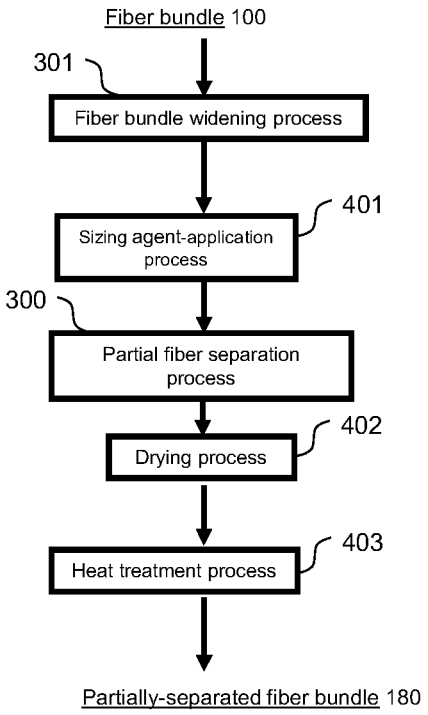
FIG. 7 is an operation flow chart in which sizing agent-application process is performed after fiber bundle widening process.

FIG. 7 shows another example of timing of the sizing agent-addition process including the sizing agent-application process, the drying process and the heat treatment process in a production process of reinforcing fiber bundle including the fiber bundle widening process in which partially-separated fiber bundle 180 is formed from fiber bundle 100 through fiber bundle widening process 301 and partial fiber separation process 300 in this order, wherein sizing agent-application process 401 of sizing agent-addition process is performed between fiber bundle widening process 301 and partial fiber separation process 300 while drying process 402 and heat treatment process 403 are performed after partial fiber separation process 300.

Thus, the sizing agent can be added at various timings in our production process of a reinforcing fiber bundle.

Region (II) of the reinforcing fiber bundle has a drape level of 120 mm or more. It is more preferably 145 mm or more, preferably 170 mm or more. The drape level of less than 120 mm might make filaments dispersed as generating fluff so that fibers cannot easily be wound off the bobbin and that fibers wind around a nip roller or a cutter blade. It is preferably 240 mm or less. It is more preferably 230 mm or less, preferably 220 mm or less. The drape level of more than 240 mm might decrease the flexibility of fiber bundle so that excessively hardened fiber bundle cannot smoothly be wound in and wound off the bobbin. It might also cause single yarn breakage so that desirable chopped fiber bundle formation cannot be achieved. The drape level of region (II) of reinforcing fiber bundle can be determined by a method to be described later.

It is preferable that region (II) of reinforcing fiber bundle has a bundle hardness of 39 g or more. It is more preferably 70 g or more, preferably 120 g or more. The bundle hardness of less than 39 g might make filaments dispersed as generating fluff so that fibers cannot easily be wound off the bobbin and that fibers wind around a nip roller or a cutter blade. It is preferable that region (II) of the reinforcing fiber bundle has a bundle hardness of 200 g or less. It is more preferably 190 g or less, preferably 180 g or less. The fiber bundle hardness of more than 200 g may deteriorate winding of the reinforcing fiber bundle up with a winder and fail to achieve the desired advantages. The hardness of region (II) of reinforcing fiber bundle can be determined by a method to be described later.

It is preferable that region (II) of reinforcing fiber bundle contains single yarns per unit width of 600 fibers/mm or more. It is more preferably 700 fibers/mm or more, preferably 800 fibers/mm or more. The content of less than 600 fibers/mm might cause a poor fluidity of forming material. It is preferably 1,600 fibers/mm or less. It is more preferably 1,400 fibers/mm or less, preferably 1,250 fibers/mm or less. The content of more than 1,600 fibers/mm might cause poor mechanical properties of shaped product. The single yarn number per unit width of region (II) of reinforcing fiber bundle can be determined by a method to be described later.

It is preferable that region (II) of reinforcing fiber bundle has an average bundle thickness of 0.01 mm or more. It is more preferably 0.03 mm or more, preferably 0.05 mm or more. The thickness of less than 0.01 mm might cause a poor fluidity of forming material. It is preferable that region (II) of reinforcing fiber bundle has an average bundle thickness of 0.2 mm or less. It is more preferably 0.18 mm or less, preferably 0.16 mm or less. The thickness of more than 0.2 mm might cause poor mechanical properties of shaped product.

It is preferable that region (II) of reinforcing fiber bundle has an average bundle width of 0.03 mm or more. It is more preferably 0.05 mm or more, preferably 0.07 mm or more. The width of less than 0.03 mm might cause a poor fluidity of forming material. It is preferable that region (II) of reinforcing fiber bundle has an average bundle width of 3 mm or less. It is more preferably 2 mm or less, preferably 1 mm or less. The width of more than 3 mm might cause poor mechanical properties of shaped product.

It is preferable that region (II) of reinforcing fiber bundle has width change rate W2/W1 of 0.5 or more, where W1 is a width of reinforcing fiber bundle before being immersed in water and W2 is a width of the reinforcing fiber bundle after being immersed in water at 25° C. for 5 min and taken out to drain water for 1 min. It is more preferably 0.6 or more, preferably 0.7 or more. When the width change rate W2/W1 is less than 0.5, residual water-soluble property of sizing agent which adheres to the discontinuous reinforcing fiber bundle might make the separated fiber bundles reaggregate after fiber separation process so that the fiber bundle is difficult to maintain the formation in which the number of single yarns is optimally adjusted. Unless the fiber bundle maintains the formation in which the number of single yarns is optimally adjusted, it is difficult to achieve a good balance between fluidity at the time of forming and mechanical properties of shaped product because the formation may not be optimized in an intermediate base material of discontinuous fiber bundle made by cutting/dispersing the separated fiber bundles for preparing a forming material to be used to form a composite material. It is preferable that width change rate W2/W1 is 1.3 or less. It is more preferably 1.2 or less, preferably 1.1 or less. The width change rate W2/W1 of more than 1.3 might cause a problem in that an excessively hardened fiber bundle cannot smoothly be wound in and wound off the bobbin. It might also cause single yarn breakage so that desirable chopped fiber bundle formation cannot be achieved. The width change rate of region (II) of reinforcing fiber bundle can be determined by a method to be described later.

The reinforcing fiber bundle is suitably used as a raw material to make a reinforced composite material. For example, our reinforcing fiber bundle is cut into a size of 3 to 20 mm to be sprayed to make bundle aggregate [F]. Bundle aggregate [F] may be impregnated with matrix resin to produce a forming material. The matrix resin may be a thermosetting resin such as epoxy resin, unsaturated polyester resin, vinyl ester resin, phenolic resin, epoxy acrylate resin, urethane acrylate resin, phenoxy resin, alkyd resin, urethane resin, maleimide resin and cyanate resin, a thermoplastic resin such as polyamide resin, polyacetal, polyacrylate, polysulfone, ABS, polyester, acrylic, polybutylene terephthalate (PBT), polyethylene terephthalate (PET), polyethylene, polypropylene, polyphenylene sulfide (PPS), polyetheretherketone (PEEK), a liquid crystal polymer, polyvinyl chloride, silicone and polytetrafluoroethylene as a fluorinated resin. It is preferable that a polyamide-based resin is selected from the thermoplastic resin. It is further preferable that an inorganic antioxidant is blended with polyamide. The thermoplastic polyamide resin may be a ring-opened polymer of cyclic lactam or a polycondensate of w-aminocarboxylic acid such as nylon 6, nylon 11 and nylon 12, a polycondensate of diamine and dicarboxylic acid such as nylon 610, nylon 612, nylon 6T, nylon 61, nylon 9T, nylon M5T and nylon MFD6, a copolymerized nylon polycondensate of two or more kinds of diamine and dicarboxylic acid such as nylon 66.6.61 and nylon 66.6.12, or the like. From viewpoints of mechanical properties and cost, it is preferable to employ nylon 6, 66 or 610.

It is possible to add a copper halide or derivative thereof such as copper iodide, copper bromide, copper chloride and complex salt of mercaptobenzimidazole and copper iodide. It is preferable to use copper iodide or complex salt of mercaptobenzimidazole and copper iodide. It is preferable that the copper halide or derivative thereof is added by 0.001 to 5 parts by weight to 100 parts by weight of thermoplastic polyamide resin. The additive amount of less than 0.001 might not sufficiently suppress resin decomposition, fume and odor at the time of preheating while the additive amount of more than 5 parts by weight might not improve the effect. It is preferably 0.002 to 1 parts by weight from a viewpoint of balance between heat stabilization effect and cost.

To impregnate bundle aggregate [F] with matrix resin, it is possible that fiber bundle aggregate [F] containing thermoplastic resin fiber is prepared to use the thermoplastic resin fiber as a matrix resin, or alternatively, fiber bundle aggregate [F] containing no thermoplastic resin fiber may be impregnated with matrix resin at any stage of producing fiber-reinforced resin forming material.

Even fiber bundle aggregate [F] containing thermoplastic resin fiber used as a raw material may be impregnated with matrix resin at any stage of producing fiber-reinforced resin forming material. In this example, the matrix resin may be the same as or different from the resin constituting the thermoplastic resin fiber. Even when the matrix resin is different from the resin constituting the thermoplastic resin fiber, it is preferable that they are compatible to each other or alternatively have a high affinity.

To produce a fiber-reinforced resin forming material, fiber bundle aggregate [F] may be impregnated with thermoplastic resin as a matrix resin by using an impregnation pressing machine. The pressing machine capable of achieving temperature and pressure for impregnation with matrix resin may be an ordinary pressing machine having a planar platen going up and down or so-called double belt pressing machine having a mechanism of a pair of endless steel belts running. In such an impregnation process, matrix resin having a form such as film and nonwoven or woven fabric sheet may be laminated with discontinuous fiber mat to be melted and impregnated with matrix resin by using the above-described pressing machine. It is also possible that particles of matrix resin are dispersed on bundle aggregate [F] to make a laminate or are dispersed simultaneously with chopped fiber bundles to be blended inside bundle aggregate [F].

EXAMPLES

Hereinafter, our reinforcing fiber bundles will be explained in detail with reference to Examples. Methods for measurement, calculation and evaluation are as follows.

(1) Measurement Method of Average Fiber Number in Bundle

Weight a [mg/m] per unit filament length is calculated from reinforcing fiber bundle weight and filament number per 1 m length. Next, fiber length L [mm] and weight b [mg] of separated reinforcing fiber bundle having a length of about 10 mm cut from a separated fiber section are measured to calculate the fiber number in bundle by the following formula. The fiber number in bundle is averaged among 20 samples to make an average fiber number in bundle.

$$\text{Average fiber number in bundle}=b\times 1000/(a\times L)$$

(2) Measurement Method of Adhesion Amount of Sizing Agents (I) and (II)

About 5 g of carbon fiber bundle with sizing agent is sampled in a heat resistant container. The container is dried up at 80° C. under vacuum condition for 24 hours and then cooled down to room temperature as preventing it from absorbing moisture. After weight m1 [g] of carbon fiber is measured, a whole container is subjected to an ashing process at 500° C. for 15 min in nitrogen atmosphere. It is cooled down to room temperature as preventing it from absorbing moisture to measure weight m2 [g] of carbon fiber. Through the above-described processes, adhesion amount of sizing agent to carbon fiber is calculated according to the following formula. The measurement results of 10 pieces of fiber bundles are averaged.

$$\text{Adhesion amount of sizing agent [wt \%]}=100\times(m1-m2)/m1$$

(3) Measurement Method of Heat Decomposition Start Temperature

The heat decomposition start temperature of sizing agent (II) is determined as follows. A 5 mg sample of reinforcing fiber with sizing agent (II) applied is dried at 110° C. for 2 hours and then cooled down in a desiccator at room temperature for 1 hour. It is weighed and subjected to TGA measurement in nitrogen atmosphere. The weight decrease from room temperature to 650° C. is measured, in a condition of 100 ml/min of nitrogen flow rate and 10° C./min of temperature increase rate. In the TGA curve of which vertical axis is weight ratio [%] of sizing agent-applied yarn to the initial yarn and of which horizontal axis is temperature [° C.], two tangent lines are drawn at the first temperature of maximum weight decrease rate [%/° C.] and at the second temperature of local minimum weight decrease rate, the second temperature adjacent to the first temperature higher. The heat decomposition start temperature is defined as a temperature of the intersection point of the tangent lines.

The definition of the heat decomposition start temperature is applied to a state after the chemical denaturation of sizing agent and before the matrix resin impregnation. When the heat decomposition start temperature of sizing agent (II)-applied reinforcing fiber cannot be determined, sizing agent (II) may be used in place of the reinforcing fiber.

(4) Measurement Method of Drape Level

Figure 8:
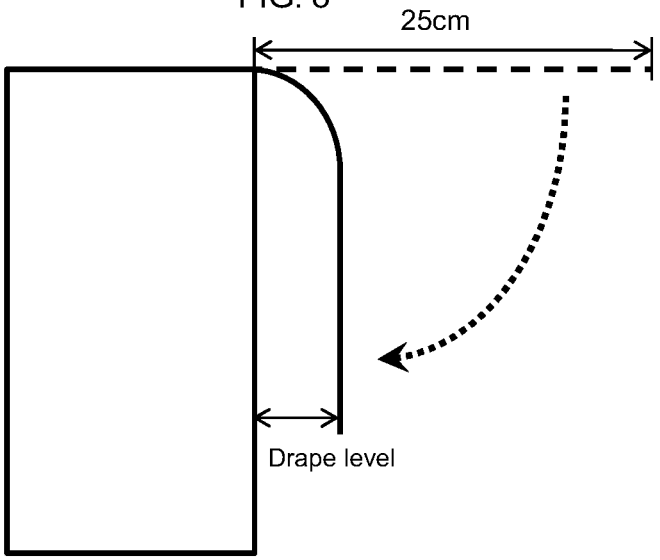
FIG. 8 is a schematic explanation view showing a measurement method of drape level.

A reinforcing fiber bundle in region (II) cut into 30 cm length is laid straight on a flat plate to make sure there are no curves and twists. Curves or twists as much as possible to be found are removed by heating under 100° C. or by pressurizing under 0.1 MPa. As shown in FIG. 8, the reinforcing fiber bundle cut into 30 cm length is fixed to an edge of cuboid stand in an atmosphere at 23±5° C., the reinforcing fiber bundle protruding by 25 cm from the edge of the stand to make a 5 cm part from one edge of the reinforcing fiber bundle positioned at the edge of the stand. After leaving it for 5 min, the shortest distance between the other edge of the reinforcing fiber bundle and the side end of the stand is measured. The drape level is defined as an average value among measurement samples of n=5.

(5) Measurement Method of Bundle Hardness

The hardness of the reinforcing fiber bundle is determined with HANDLE-O-Meter ("CAN-1MCB" made by DAIEI KAGAKU SEIKI MFG. Co., Ltd.) according to JIS L-1096 with E method (Handle-o-meter method). A test piece having 10 cm length and 1 mm width with 1,600 filaments is prepared by opening a reinforcing fiber bundle. The slit width is set to 20 mm. The reinforcing fiber bundle test piece placed on a test stand provided with the slit groove is pushed by a blade into the groove by a predetermined depth such as 8 mm depth while the resisting force [g] is measured. The hardness of reinforcing fiber bundle is defined as an average value of measured resisting force among 3 samples.

(6) Average Bundle Thickness

The thickness is measured at 20 points at intervals of every 30 cm along the longitudinal direction (fiber direction) of fiber bundle to calculate an average fiber bundle thickness.

(7) Average Fiber Bundle Width

The bundle width is measured at 20 points at intervals of every 30 cm in a separated fiber section along the longitudinal direction (fiber direction) of fiber bundle to calculate an average fiber bundle width.

(8) Single Yarn Number Per Unit Width

The single yarn number per unit width is calculated by dividing average fiber number in bundle by average fiber bundle width.

(9) Measurement of Width Change Rate of Sizing Agent-Applied Reinforcing Fiber Bundle A carbon fiber bundle which has been prepared by widening to 50 mm width from 40 mm width before the reinforcing fiber bundle separation is applied with sizing agent and cut into 230 mm length. The first position of 30 mm from one edge of the bundle is nipped with a clip to measure widths at 5 points between the first position and the second position of 100 mm from the other edge. Width W1 before immersion is defined as an average value of the measured widths. Then, it is immersed in water at 25° C. for 5 min and is taken out to hang it so that the clipped side is up while draining water for 1 min. The width is measured at 5 points between the first position and the second position of 100 mm from the other edge. Width W2 after immersion is defined as an average value of the measured widths. The width change rate of sizing agent-applied reinforcing fiber bundle is calculated by the following formula.

$$\text{Width change rate} = W2/W1$$

(10) Mechanical Properties

A flat plate shaped product having size of 500×400 mm is prepared by forming a shape with fiber-reinforced resin forming material by the method to be described later. The flat plate is cut into size of 100×25×2 mm of total 32 test pieces of which 16 pieces are cut along the flat plate longitudinal direction (0°) and of which 16 pieces are cut along the orthogonal direction (90°). The test pieces are subjected to a measurement according to JIS K7074 (1988). Among mechanical properties, a bending strength is determined. The bending strength of less than 200 MPa is evaluated as level C, while 200 MPa or more and less than 350 MPa is evaluated as level B and 350 MPa or more is evaluated as A.

(11) Fluidity (Stamping Forming)

Resin Sheet 1

Two fiber-reinforced resin forming materials having size of 150 mm×150 mm×2 mm are stacked to be preheated to 260° C. of base material center temperature (temperature at the center of the stack). Then, the stack is pressurized at 10 MPa for 30 sec on a pressing plate heated to 150° C. The fluidity is defined as a value of A2/A1×100 [%] where A2 [$mm^2$] is an area after pressurization and A1 [$mm^2$] is an area before pressing. The fluidity of less than 200% is evaluated as level C while the fluidity of 200% or more and less than 300% is evaluated as level B and the fluidity of 300% or more is evaluated as level A.

Resin Sheet 2

Two fiber-reinforced resin forming materials having size of 150 mm×150 mm×2 mm are stacked to be preheated to 220° C. of base material center temperature (temperature at the center of the stack). Then, the stack is pressurized at 10 MPa for 30 sec on a pressing plate heated to 120° C. The fluidity is defined as a value of A2/A1×100 [%] where A2 [$mm^2$] is an area after pressurization and A1 [$mm^2$] is an area before pressing. The fluidity of less than 200% is evaluated as level C while the fluidity of 200% or more and less than 300% is evaluated as level B and the fluidity of 300% or more is evaluated as level A.

Raw Materials

Raw fiber 1: Carbon fiber bundle ("PX35" made by ZOLTEK company, single yarn number of 50,000, with sizing agent "13") is used.

Raw fiber 2: Glass fiber bundle (240TEX made by Nitto Boseki Co., Ltd., single yarn number of 1,600) is used.

Raw fiber 3: Carbon fiber bundle ("PX35" made by ZOLTEK company, single yarn number of 50,000, without sizing agent) is used.

Resin sheet 1: Polyamide master batch made of polyamide 6 resin (made by Toray Industries, Inc., "AMILAN" (registered trademark) CM1001) is used to prepare the sheet.

Resin sheet 2: Polypropylene master batch made of native polypropylene resin (made by Prime Polymer Co., Ltd., "PRIME POLYPRO" (registered trademark) J106MG) of 90 mass % and acid-modified polypropylene resin (made by Mitsui Chemicals, Inc., "ADMER" (registered trademark) QE800) of 10 mass % is used to prepare the sheet.

Sizing agent 1: Water-soluble polyamide (made by Toray Industries, Inc., "T-70") is used.

Sizing agent 2: Water-soluble polyamide (made by Toray Industries, Inc., "A-90") is used.

Sizing agent 3: Water-soluble polyamide (made by Toray Industries, Inc., "P-70") is used.

Sizing agent 4: Water-soluble polyamide (made by Toray Industries, Inc., "P-95") is used.

Production Method of Fiber-Reinforced Thermoplastic Resin Forming Material

The raw fiber rolled out by a winder constantly at 10 m/min is fed to a vibrational widening roller vibrating in the axial direction at 10 Hz to widen the width, and then fed to a width regulation roller to make a widened fiber bundle.

Then, region (I) as a part of 150 mm length from the terminal and/or region (II) as a part other than region (I) of the other part of the widened fiber bundle are continuously immersed in a sizing agent diluted with purified water. Next, heat treatment processes (I) and (II) are performed. In heat treatment process (I), the sizing agent-applied widened fiber bundle is dried to remove moisture with a hot roller at 250° C. and a drying furnace (atmospheric condition) at 250° C. to perform heat treatment for 1.5 min. (Examples 1 to 6, Comparative examples 1 to 3) In heat treatment process (II), only region (II) of the sizing agent-applied widened fiber bundle is dried to remove moisture with a hot roller at 250° C. and a drying furnace (atmospheric condition) at 250° C. to perform heat treatment for 1.5 min. (Examples 7 to 12, Comparative examples 4 to 6)

Thus obtained widened fiber bundle is fed to a fiber separation means provided with iron plates for fiber separation having a protrusive shape of 0.2 mm thickness, 3 mm width and 20 mm height, the iron plates being set in parallel at regular intervals along the reinforcing fiber bundle width. The fiber separation means is intermittently inserted in and extracted from the widened fiber bundle to make a separated reinforcing fiber bundle.

The fiber separation means is kept for 3 sec as inserted in the widened fiber bundle travelling constantly at 10 m/min to generate a separated fiber section, and then is kept for 0.2 sec as extracted therefrom. Such an insertion/extraction process is repeated.

The obtained reinforcing fiber bundle has separated fiber sections in which fiber bundles are separated with respect to the width direction to have a target average fiber number. At least one end of a separated fiber section has an accumulated interlacing section in which interlaced single yarns are accumulated. Next, the obtained reinforcing fiber bundles are continuously inserted into a rotary cutter to cut the fiber bundles into fiber length of 10 mm while terminals of the reinforcing fiber bundles being wound off the bobbin are connected to each other, and then are sprayed to be dispersed uniformly to make a discontinuous fiber nonwoven fabric having an isotropic fiber orientation.

The discontinuous fiber nonwoven fabric sandwiched vertically by resin sheets is impregnated with the resin by a pressing machine to produce a sheet of fiber-reinforced thermoplastic resin forming material.

Example 1

Reinforcing fiber bundles including region (I) (which is a part of 150 mm length from the reinforcing fiber terminal. The same applies hereinafter.) and region (II) (which is a part other than region (I). The same applies hereinafter.) to which sizing agent including sizing agent 1 was adhered by 3.2 wt % each were prepared from the raw fiber and the sizing agent shown in Table 1. Region (I) had fiber number per unit width of 1,547 (fibers/mm) and average fiber number in bundle of 10 (fibers) while region (II) had fiber number per unit width of 1,547 (fibers/mm) and average fiber number in bundle of 990 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 2

Reinforcing fiber bundles including region (I) and region (II) to which sizing agent including sizing agent 1 was adhered by 4.0 wt % each were prepared from the raw fiber and the sizing agent shown in Table 1. Region (I) had fiber number per unit width of 1,493 (fibers/mm) and average fiber number in bundle of 450 (fibers) while region (II) had fiber number per unit width of 1,493 (fibers/mm) and average fiber number in bundle of 1,030 (fibers).

The reinforcing fiber bundles were connected through their terminals by an air splicing device and chopped. From such chopped reinforcing fiber bundles and resin sheet 2, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 3

Reinforcing fiber bundles including region (I) and region (II) to which sizing agent including sizing agent 1 was adhered by 3.1 wt % each were prepared from the raw fiber and the sizing agent shown in Table 1. Region (I) had fiber number per unit width of 1,460 (fibers/mm) and average fiber number in bundle of 480 (fibers) while region (II) had fiber number per unit width of 4,372 (fibers/mm) and average fiber number in bundle of 1,880 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 4

Reinforcing fiber bundles including region (I) and region (II) to which sizing agent including sizing agent 2 was adhered by 2.8 wt % each were prepared from the raw fiber and the sizing agent shown in Table 1. Region (I) had fiber number per unit width of 1,543 (fibers/mm) and average fiber number in bundle of 540 (fibers) while region (II) had fiber number per unit width of 1,543 (fibers/mm) and average fiber number in bundle of 5,230 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 5

Reinforcing fiber bundles including region (I) and region (II) to which sizing agent including sizing agent 2 was adhered by 3.3 wt % each were prepared from the raw fiber and the sizing agent shown in Table 1. Region (I) had fiber number per unit width of 1,130 (fibers/mm) and average fiber number in bundle of 90 (fibers) while region (II) had fiber number per unit width of 547 (fibers/mm) and average fiber number in bundle of 410 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 6

Reinforcing fiber bundles including region (I) and region (II) to which sizing agent including sizing agent 3 was adhered by 5.5 wt % each were prepared from the raw fiber and the sizing agent shown in Table 1. Region (I) had fiber number per unit width of 1,420 (fibers/mm) and average fiber number in bundle of 110 (fibers) while region (II) had fiber number per unit width of 1,476 (fibers/mm) and average fiber number in bundle of 930 (fibers).

The reinforcing fiber bundles were connected through their terminals by an air splicing device and chopped. From such chopped reinforcing fiber bundles and resin sheet 2, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 7

Reinforcing fiber bundles including region (I) and region (II) to which sizing agent including sizing agent 1 was adhered by 3.2 wt % each were prepared as shown in Table 1. Region (I) had fiber number per unit width of 1,540 (fibers/mm) while region (II) had fiber number per unit width of 1,540 (fibers/mm) and average fiber number in bundle of 990 (fibers). Besides, sizing agent 1 was added to sizing agent "13"-added raw fiber 1 in this example. Other examples are the same as well.

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 8

Reinforcing fiber bundles including region (I) and region (II) to which sizing agent including sizing agent 1 was adhered by 4.0 wt % each were prepared as shown in Table 1. Region (I) had fiber number per unit width of 1,480 (fibers/mm) while region (II) had fiber number per unit width of 1,480 (fibers/mm) and average fiber number in bundle of 1,030 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 9

Reinforcing fiber bundles including region (I) and region (II) to which sizing agent including sizing agent 1 was adhered by 3.1 wt % each were prepared as shown in Table 1. Region (I) had fiber number per unit width of 1,460 (fibers/mm) while region (II) had fiber number per unit width of 4,380 (fibers/mm) and average fiber number in bundle of 1,880 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 10

Reinforcing fiber bundles including region (I) and region (II) to which sizing agent including sizing agent 2 was adhered by 2.8 wt % each were prepared as shown in Table 1. Region (I) had fiber number per unit width of 1,520 (fibers/mm) while region (II) had fiber number per unit width of 1,540 (fibers/mm) and average fiber number in bundle of 5,230 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 11

Reinforcing fiber bundles including region (I) and region (II) to which sizing agent including sizing agent 2 was adhered by 3.3 wt % each were prepared as shown in Table 1. Region (I) had fiber number per unit width of 1,130 (fibers/mm) while region (II) had fiber number per unit width of 550 (fibers/mm) and average fiber number in bundle of 410 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Example 12

Reinforcing fiber bundles including region (I) and region (II) to which sizing agent including sizing agent 3 was adhered by 5.5 wt % each were prepared as shown in Table 1. Region (I) had fiber number per unit width of 1,420 (fibers/mm) while region (II) had fiber number per unit width of 1,480 (fibers/mm) and average fiber number in bundle of 930 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 1

Reinforcing fiber bundles including region (I) and region (II) to which sizing agent including sizing agent 3 was adhered by 3.3 wt % each were prepared from the raw fiber and the sizing agent shown in Table 1. Region (I) had fiber number per unit width of 2,870 (fibers/mm) and average fiber number in bundle of 890 (fibers) while region (II) had fiber number per unit width of 2,610 (fibers/mm) and average fiber number in bundle of 1,540 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 2

Reinforcing fiber bundles including region (I) and region (II) to which sizing agent including sizing agent 4 was adhered by 2.9 wt % each were prepared from the raw fiber and the sizing agent shown in Table 1. Region (I) had fiber number per unit width of 1,550 (fibers/mm) and average fiber number in bundle of 2,270 (fibers) while region (II) had fiber number per unit width of 3,486 (fibers/mm) and average fiber number in bundle of 5,020 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 3

Reinforcing fiber bundles including region (I) and region (II) to which sizing agent including sizing agent 4 was adhered by 4.7 wt % each were prepared from the raw fiber and the sizing agent shown in Table 1. Region (I) had fiber number per unit width of 1,580 (fibers/mm) and average fiber number in bundle of 210 (fibers) while region (II) had fiber number per unit width of 4,000 (fibers/mm) and average fiber number in bundle of 1,120 (fibers).

The reinforcing fiber bundles were connected through their terminals by an air splicing device and chopped. From such chopped reinforcing fiber bundles and resin sheet 1, a fiber-reinforced thermoplastic resin forming material was produced. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 4

Reinforcing fiber bundles including region (I), to which no sizing agent was added, and region (II) to which sizing agent including sizing agent 3 was adhered by 3.3 wt % were prepared as shown in Table 1. Region (I) had fiber number per unit width of 2,870 (fibers/mm) while region (II) had fiber number per unit width of 2,580 (fibers/mm) and average fiber number in bundle of 1,540 (fibers). Besides, the sizing agent adhesion detected in region (I) seems to derive from sizing agent "13" present in raw fiber 1.

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 5

Reinforcing fiber bundles including region (I), to which no sizing agent was added, and region (II) to which sizing agent including sizing agent 4 was adhered by 4.7 wt % were prepared as shown in Table 1. Region (I) had fiber number per unit width of 1,580 (fibers/mm) while region (II) had fiber number per unit width of 3,940 (fibers/mm) and average fiber number in bundle of 1,120 (fibers). Besides, the sizing agent adhesion detected in region (I) seems to derive from sizing agent "13" present in raw fiber 1.

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

Comparative Example 6

Reinforcing fiber bundles were prepared as shown in Table 1, in which sizing agent including sizing agent 4 was adhered to region (I) by 13.0 wt % and was adhered to region (II) by 3.1 wt %. Region (I) had fiber number per unit width of 1,420 (fibers/mm) while region (II) had fiber number per unit width of 1,480 (fibers/mm) and average fiber number in bundle of 930 (fibers).

The reinforcing fiber bundles were connected through their terminals (region (I)) which had been wound off the bobbin and overlapped to each other to pressurize the overlap at 250° C. and 0.1 MPa for 1 min. The connected reinforcing fiber bundles were chopped to prepare a discontinuous fiber nonwoven fabric. The discontinuous fiber nonwoven fabric was impregnated with the matrix resin shown in Table 2 as being heated to produce a fiber-reinforced thermoplastic resin forming material. Table 2 shows evaluation results of processability at the connection part (A: without disconnection, B: with disconnection of 1 to 7 times per 10 times, C: with disconnection of 8 times or more per 10 times), mechanical properties and fluidity of shaped product.

TABLE 1

| | | Sizing agent added | | |
|---|---|---|---|---|
| | Raw fiber | Region (I) | Region (II) | Matrix resin |
| Example 1 | Raw fiber 1 | Sizing agent 1 | Sizing agent 1 | Resin sheet 1 |
| Example 2 | Raw fiber 3 | Sizing agent 1 | Sizing agent 1 | Resin sheet 2 |
| Example 3 | Raw fiber 1 | Sizing agent 1 | Sizing agent 1 | Resin sheet 1 |
| Example 4 | Raw fiber 1 | Sizing agent 2 | Sizing agent 2 | Resin sheet 1 |
| Example 5 | Raw fiber 2 | Sizing agent 2 | Sizing agent 2 | Resin sheet 1 |
| Example 6 | Raw fiber 3 | Sizing agent 3 | Sizing agent 3 | Resin sheet 2 |
| Example 7 | Raw fiber 1 | Sizing agent 1 | Sizing agent 1 | Resin sheet 1 |
| Example 8 | Raw fiber 3 | Sizing agent 1 | Sizing agent 1 | Resin sheet 2 |
| Example 9 | Raw fiber 1 | Sizing agent 1 | Sizing agent 1 | Resin sheet 1 |
| Example 10 | Raw fiber 1 | Sizing agent 2 | Sizing agent 2 | Resin sheet 1 |
| Example 11 | Raw fiber 2 | Sizing agent 2 | Sizing agent 2 | Resin sheet 1 |
| Example 12 | Raw fiber 3 | Sizing agent 3 | Sizing agent 3 | Resin sheet 2 |
| Comparative example 1 | Raw fiber 1 | Sizing agent 3 | Sizing agent 3 | Resin sheet 1 |
| Comparative example 2 | Raw fiber 1 | Sizing agent 4 | Sizing agent 4 | Resin sheet 1 |
| Comparative example 3 | Raw fiber 1 | Sizing agent 4 | Sizing agent 4 | Resin sheet 1 |
| Comparative example 4 | Raw fiber 1 | — | Sizing agent 3 | Resin sheet 1 |
| Comparative example 5 | Raw fiber 1 | — | Sizing agent 4 | Resin sheet 1 |
| Comparative example 6 | Raw fiber 3 | Sizing agent 4 | Sizing agent 4 | Resin sheet 2 |

TABLE 2

| | | Sizing process | | | | | | | | | |
|---|---|---|---|---|---|---|---|---|---|---|---|
| | | Region (I) | | | | | Region (II) | | | | |
| | Reinforcing fiber bundle Total fiber number | Heat treatment | Sizing agent adhesion amount [wt %] | Division number | Average fiber number in bundle [fibers] | Fiber number per unit width [fibers/mm] | Heat treatment | Division number | Average fiber number in bundle [fibers] | Drape level [mm] | Bundle hardness [g] |
| Example 1 | 50,000 | Present | 3.2 | 5,000 | 10 | 1,547 | Present | 51 | 990 | 138 | 81 |
| Example 2 | 50,000 | Present | 4.0 | 111 | 450 | 1,493 | Present | 49 | 1,030 | 142 | 89 |
| Example 3 | 50,000 | Present | 3.1 | 104 | 480 | 1,460 | Present | 27 | 1,880 | 233 | 195 |

TABLE 2-continued

| | | | | | | | | | | | |
|---|---|---|---|---|---|---|---|---|---|---|---|
| Example 4 | 50,000 | Present | 2.8 | 93 | 540 | 1,543 | Present | 10 | 5,230 | 133 | 78 |
| Example 5 | 1,600 | Present | 3.3 | 18 | 90 | 1,130 | Present | 4 | 410 | 127 | 76 |
| Example 6 | 50,000 | Present | 5.5 | 455 | 110 | 1,420 | Present | 54 | 930 | 180 | 123 |
| Example 7 | 50,000 | — | 3.2 | 5,000 | 10 | 1,540 | Present | 51 | 990 | 138 | 81 |
| Example 8 | 50,000 | — | 4.0 | 111 | 450 | 1,480 | Present | 49 | 1,030 | 142 | 89 |
| Example 9 | 50,000 | — | 3.1 | 104 | 480 | 1,460 | Present | 27 | 1,880 | 233 | 195 |
| Example 10 | 50,000 | — | 2.8 | 93 | 540 | 1,520 | Present | 10 | 5,230 | 133 | 78 |
| Example 11 | 1,600 | — | 3.3 | 18 | 90 | 1,130 | Present | 4 | 410 | 127 | 76 |
| Example 12 | 50,000 | — | 5.5 | 455 | 110 | 1,420 | Present | 54 | 930 | 180 | 123 |
| Comparative example 1 | 50,000 | Present | 3.3 | 56 | 890 | 2,870 | Present | 32 | 1,540 | 204 | 163 |
| Comparative example 2 | 50,000 | Present | 2.9 | 22 | 2,270 | 1,550 | Present | 10 | 5,020 | 225 | 188 |
| Comparative example 3 | 50,000 | Present | 4.7 | 238 | 210 | 1,580 | Present | 45 | 1,120 | 243 | 220 |
| Comparative example 4 | 50,000 | — | 1.5 | 56 | 890 | 2,870 | Present | 32 | 1,540 | 204 | 163 |
| Comparative example 5 | 50,000 | — | 1.6 | 238 | 210 | 1,580 | Present | 45 | 1,120 | 243 | 220 |
| Comparative example 6 | 50,000 | — | 13.0 | 455 | 110 | 1,420 | Present | 54 | 930 | 145 | 84 |

| | Sizing process Region (II) | | | | | | | Stampable sheet | |
|---|---|---|---|---|---|---|---|---|---|
| | Width change Rate | Thickness [mm] | Fiber number per unit width [fibers/mm] | Bundle width [mm] | Sizing agent heat decomposition start temperature [° C.] | Sizing agent adhesion amount [wt %] | Mat Processability | Mechanical properties | Fluidity |
| Example 1 | 0.85 | 0.07 | 1,547 | 0.64 | 360 | 3.2 | A | A | B |
| Example 2 | 0.91 | 0.07 | 1,493 | 0.69 | 360 | 4.0 | B | A | A |
| Example 3 | 0.78 | 0.23 | 4,372 | 0.43 | 360 | 3.1 | B | B | A |
| Example 4 | 0.87 | 0.07 | 1,543 | 3.39 | 350 | 2.8 | B | B | A |
| Example 5 | 0.81 | 0.07 | 547 | 0.75 | 350 | 3.3 | A | B | B |
| Example 6 | 0.92 | 0.07 | 1,476 | 0.63 | 350 | 5.5 | A | B | B |
| Example 7 | 0.85 | 0.07 | 1,540 | 0.6 | 360 | 3.2 | A | A | B |
| Example 8 | 0.91 | 0.07 | 1,480 | 0.7 | 360 | 4.0 | A | A | A |
| Example 9 | 0.78 | 0.23 | 4,380 | 0.4 | 360 | 3.1 | A | B | A |
| Example 10 | 0.87 | 0.07 | 1,540 | 3.4 | 350 | 2.8 | A | B | A |
| Example 11 | 0.81 | 0.07 | 550 | 0.7 | 350 | 3.3 | A | B | B |
| Example 12 | 0.92 | 0.07 | 1,480 | 0.6 | 350 | 5.5 | A | B | B |
| Comparative example 1 | 0.88 | 0.12 | 2,610 | 0.59 | 350 | 3.3 | C | A | A |
| Comparative example 2 | 0.87 | 0.16 | 3,486 | 1.44 | 360 | 2.9 | C | C | A |
| Comparative example 3 | 0.91 | 0.18 | 4,000 | 0.28 | 360 | 4.7 | B | B | B |
| Comparative example 4 | 0.88 | 0.12 | 2,580 | 0.6 | 350 | 3.3 | C | A | A |
| Comparative example 5 | 0.91 | 0.18 | 3,940 | 0.3 | 360 | 4.7 | C | B | B |
| Comparative example 6 | — | 0.07 | 1,480 | 0.6 | 360 | 3.1 | C | B | B |

INDUSTRIAL APPLICATIONS

Our reinforcing fiber bundle is applicable to materials of discontinuous reinforcing fiber composite for automotive interior/exterior, electric/electronic equipment housing, bicycle, airplane interior, box for transportation or the like.

The invention claimed is:

1. A continuous reinforcing fiber bundle having a length of 1 m or more, consisting of regions (I) of 150 mm length parts from the fiber bundle terminals and region (II) of a part other than the regions (I), the regions (I) having a single yarn number per unit width of 1,600 fibers/mm or less and having an average fiber number in bundle of 1,000 fibers or less, and the region (II) having a drape level of 120 mm or more and 240 mm or less, wherein an unseparated fiber section is 3 to 50% of a full length of the continuous reinforcing fiber bundle, and the region (I) has a division number of 93 or more and 5,000 or less while the region (II) has a division number of 10 or more and 54 or less.

2. The continuous reinforcing fiber bundle according to claim 1, wherein a sizing agent containing an epoxy resin as a main component is added to the region (II).

3. The continuous reinforcing fiber bundle according to claim 1, wherein a sizing agent containing a polyamide resin as a main component is added to the region (II).

4. The continuous reinforcing fiber bundle according to claim 1, wherein the region (II) has an average fiber number in bundle of 50 fibers or more and 4,000 fibers or less.

5. The continuous reinforcing fiber bundle according to claim 1, wherein the region (II) has a bundle hardness of 39 g or more and 200 g or less.

6. The continuous reinforcing fiber bundle according to claim 1, wherein the region (II) has a single yarn number per unit width of 600 fibers/mm or more and 1,600 fibers/mm or less.

7. The continuous reinforcing fiber bundle according to claim 1, wherein the region (II) has an average bundle thickness of 0.01 mm or more and 0.2 mm or less.

8. The continuous reinforcing fiber bundle according to claim 1, wherein the region (II) has an average bundle width of 0.03 mm or more and 3 mm or less.

9. The continuous reinforcing fiber bundle according to claim 1, wherein the region (II) has a sizing agent adhesion amount of 0.1 wt % or more and 5 wt % or less to 100 wt % in total weight of the region (II).

10. The continuous reinforcing fiber bundle according to claim 4, wherein the region (II) has an average fiber number in bundle of 410 fibers or more and 1,880 fibers or less.

11. The continuous reinforcing fiber bundle according to claim 1, wherein the region (II) has an average fiber number in bundle greater than that of the region (I).

12. The continuous reinforcing fiber bundle according to claim 1, wherein the region (I) has an average fiber number in bundle of 10 fibers or more and 540 fibers or less while the region (II) has an average fiber number in bundle of 930 fibers or more and 5,230 fibers or less.

13. A continuous reinforcing fiber bundle having a length of 1 m or more, consisting of regions (I) of 150 mm length parts from the fiber bundle terminals and region (II) of a part other than the regions (I), the region (I) having a sizing agent adhesion amount of 0.5 wt % or more and 10 wt % or less based on total weight of the region (I), and the region (II) having a drape level of 120 mm or more and 240 mm or less, wherein an unseparated fiber section is 3 to 50% of a full length of the continuous reinforcing fiber bundle, and the region (I) has a division number of 93 or more and 5,000 or less while the region (II) has a division number of 10 or more and 54 or less.

14. The continuous reinforcing fiber bundle according to claim 13, wherein a sizing agent made of a water-soluble polyamide is added to the regions (I).

* * * * *